US006029037A

United States Patent [19]

Ito

[11] Patent Number: 6,029,037

[45] Date of Patent: Feb. 22, 2000

[54] TRANSFER DEVICE EMPLOYING A TRANSFER ELECTRODE IN THE VICINITY OF AN IMAGE BEARING BODY

[75] Inventor: Nobuyuki Ito, Shizuoka-ken, Japan

[73] Assignee: Canon Kabushiki Kaisha, Tokyo, Japan

[21] Appl. No.: 09/337,346

[22] Filed: Jun. 21, 1999

[30] Foreign Application Priority Data

Jun. 24, 1998 [JP] Japan ..... 10-177141
Nov. 13, 1998 [JP] Japan ..... 10-323533

[51] Int. Cl.[7] ..... G03G 15/16

[52] U.S. Cl. ..... 399/310; 399/314; 399/297

[58] Field of Search ..... 399/297, 310, 399/313, 314, 316, 82, 317, 66, 302, 308

[56] References Cited

U.S. PATENT DOCUMENTS 3,869,202 3/1975 Tabata et al. ..... 399/82 X
5,552,873 9/1996 Hirao et al. ..... 399/314 X
5,594,538 1/1997 Takekoshi et al. ..... 399/310
5,671,464 9/1997 Kubota ..... 399/302 X
5,729,788 3/1998 Hirohashi et al. ..... 399/66
5,752,130 5/1998 Tanaka et al. ..... 399/308 X

FOREIGN PATENT DOCUMENTS 5-6104 1/1993 Japan .
6-317994 11/1994 Japan .

*Primary Examiner*—Susan S. Y. Lee
*Attorney, Agent, or Firm*—Fitzpatrick, Cella, Harper & Scinto

[57] ABSTRACT

A transfer device including a transfer electrode to which a voltage of a polarity opposite to that of a charged toner is applied, and an insulating support member which makes pressure contact with the image bearing body and supports the transfer electrode in a manner such that the transfer electrode is out of contact with the image bearing body and in contact with a copy sheet.

9 Claims, 4 Drawing Sheets

TRANSFER DEVICE EMPLOYING A TRANSFER ELECTRODE IN THE VICINITY OF AN IMAGE BEARING BODY

BACKGROUND OF THE INVENTION

1. Field of the Invention

The present invention relates to transfer devices for transferring an image from an image bearing body such as a photoconductive body or dielectric body to a copy sheet, and, more particularly, to a transfer device for use in an electrophotographic apparatus or electrostatic recording apparatus.

2. Description of the Related Art

In image forming apparatuses such as an electrophotographic apparatus, generally, an electrostatic latent image is formed on a photoconductive body, and a developer image is developed by letting a developer adhere electrostatically to the electrostatic latent image. The developer image may be then transferred to a copy sheet by a transfer device.

There are known transfer means for this purpose, such as, electrostatic means employing a corona transfer method and a roller transfer method, and mechanical means employing an adhesion transfer method.

Since the hazard of ozone generated in the corona discharge process is becoming a public concern, means for removing ozone is generally incorporated into this type of apparatus, or such an apparatus may employ a roller transfer method generating less ozone. However, there is a growing demand for a compact design of this type of apparatus.

The roller transfer method allows a copy sheet to smoothly advance to a transfer position. However, the roller transfer method requires that the copy sheet be pressed against the developer image on a photoconductive body at an appropriate pressure. If the level of pressure is not sufficient, a transfer fault takes place. For this reason, a high machining accuracy and an appropriate softness are required of the photoconductive body. A transfer fault may also take place if the electric resistance of rubber forming the transfer roller is too high. The requirement that makes even more rigorous the selection criterion of the material of the roller is a roller surface property. To withstand repeated uses, the surface of a roller, in direct contact with the photoconductive body and subject to smear, needs to be clean, smooth, and needs to have minimal friction resistance. However, the rubber material used for the rollers typically has a coarse surface and a large friction resistance. Finding a proper rubber material for the surface of the roller which is easy to clean and satisfies elasticity conditions is extremely difficult. For this reason, conventionally, the roller is frequently replaced, rather than employing a cleaning unit, or instead, the apparatus is often provided with a complex cleaning unit. Accordingly, the apparatus has room for improvement in cost and technical viewpoints.

Japanese Patent Laid-Open No. 5-6104 discloses contact-type transfer means as a transfer device. To resolve the problems of pressure and smear, the contact type transfer means employs a slider having a contact made of fiber, rubber or resin, which has both elasticity and electric conductivity, and also employs an AC bias.

In the transfer device disclosed in Japanese Patent Laid-Open 5-6104, setting electrical conductivity and elasticity of the elastic, electrically conductive contact to their proper values is extremely difficult (increasing electrical conductivity in a material tends to increase the hardness of the material). Because the conductive contact makes sliding contact with a photoconductive body, streak scratches occur on the surface of the photoconductive body, due to the hardness of the material. This causes the surface of the photoconductive body to be ground and the life of the photoconductive body to be shortened.

SUMMARY OF THE INVENTION

It is an object of the present invention to provide a transfer device that prevents a copy sheet from being smeared on its back side.

It is another object of the present invention to provide a transfer device that assures a precise gap between a transfer electrode and an image bearing body.

It is yet another object of the present invention to provide a transfer device employing transfer means that includes a transfer electrode to which a voltage of a polarity opposite to that of a charged toner may be applied, and an insulating support member, making pressure contact with the image bearing body, which supports the transfer electrode in a manner such that the transfer electrode is out of contact with the image bearing body and in contact with a copy sheet.

In a preferred embodiment of the present invention, a transfer device is provided that includes an image bearing body bearing a toner image to be transferred to a copy medium, an electrode providing a charge to the copy medium, and a support member in pressure contact with the image bearing body. The electrode is positioned on the support member, is out of contact with the image bearing body, and comes in contact with the copy medium when the copy medium is fed through the transfer device.

These and other objects of the present invention will become apparent from the following explanation of the invention.

DESCRIPTION OF THE PREFERRED EMBODIMENTS

Embodiments of the present invention will be described with reference to the drawings.

First embodiment

Figure 1A:
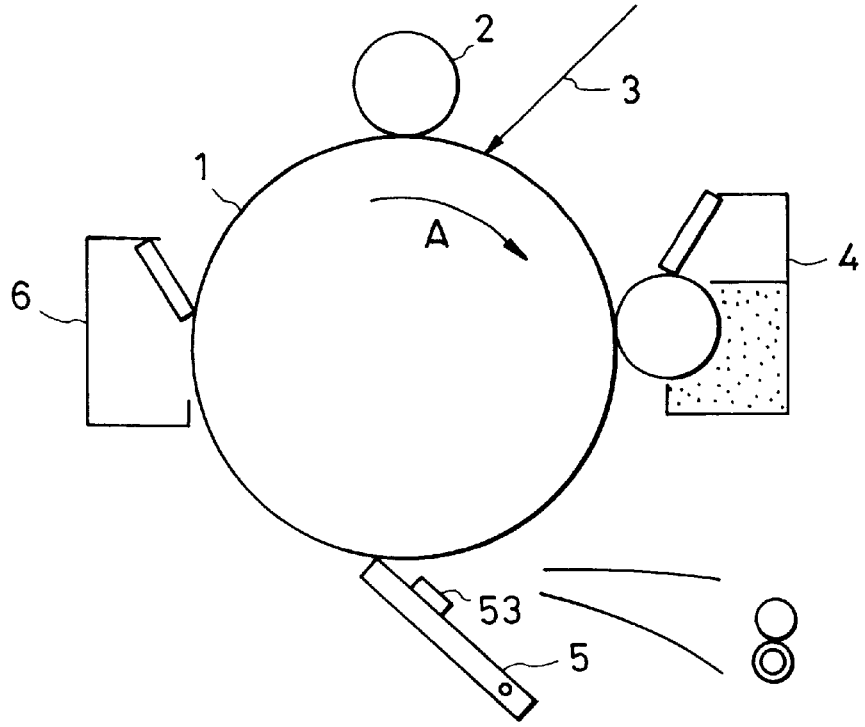
FIG. 1A and FIG. 1B are cross-sectional views showing a critical portion of an image forming apparatus that incorporates a transfer device of one embodiment of the present invention.
Figure 1B:
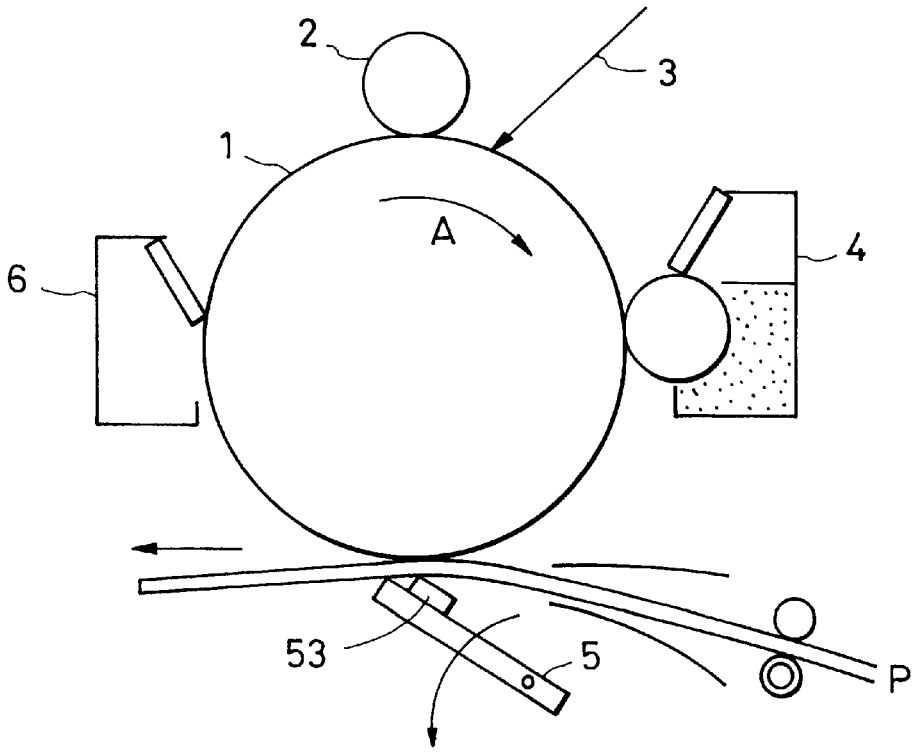

FIGS. 1A and 1B diagrammatically show an image forming apparatus of a first embodiment of the present invention. A photoconductive drum 1, as an image bearing body, may rotate at a process speed of 100 mm/s in the direction of arrow A. The photoconductive drum 1 may be constructed of a photoconductive body of an organic photosensitive material, and a grounded electrically conductive base supporting the photoconductive body. The electrophotographic recording apparatus includes the photoconductive drum 1 and units arranged surrounding the photoconductive drum 1 including a charging unit 2, an exposure unit 3, a developing unit 4, a transfer device 5, and a cleaning unit 6.

Charging means for primary charging may be a corona charging unit using a non-contact method or a roller charging unit using a contact method.

The charging and exposure conditions with a semiconductor laser used as the exposure means may be as follows: the drum may be charged to −400 V, and the exposure unit may provide uniform potential of −50 V. In this embodiment, a laser optical system was used for the exposure unit 3. Alternatively, the exposure means may be an LED with a selfoc lens, an EL device, or a plasma light emitting device.

The development conditions of the developing unit 4 are preferably as follows. The photoconductive drum 1 is spaced from a developing sleeve by 300 $\mu$m. When a development bias of 150 V, with its AC component being 2.0 Khz and 1.5 kVpp rectangular wave and its DC component being −200 V, is used, a good dot reproducibility in development contrast may be obtained.

Preferably, a negatively charged single-component magnetic toner is used. The toner radius of average weight toner may be 5 $\mu$m or larger. The weight of the magnetic material of the magnetic toner may be 10% by weight, or greater.

Figure 2A:
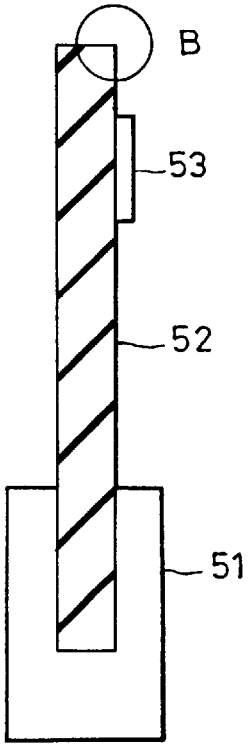
FIG. 2A is a cross-sectional view of transfer means used in the transfer device shown in FIGS. 1A and 1B.
Figure 2B:
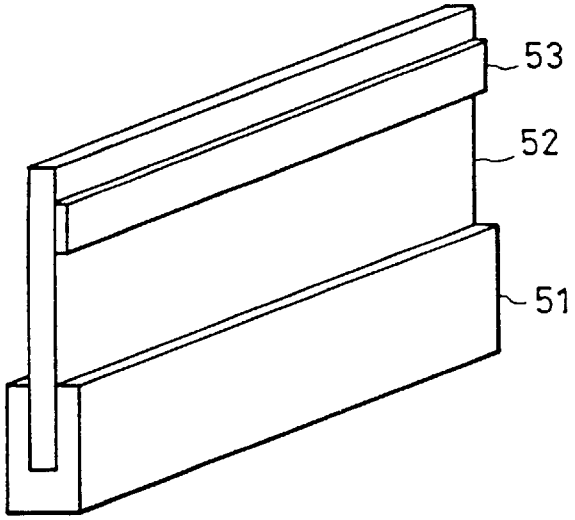
FIG. 2B is a perspective view of the transfer means shown in FIG. 2A.

The transfer device 5 generally faces the photoconductive drum 1 from below. A transport path of a copy sheet runs between the photoconductive drum 1 and the transfer device 5. A portion of the transfer device 5 is shown in FIGS. 2A and 2B. Specifically, the transfer device 5 includes a support member 51, preferably made of a metal, an insulating material 52, made of elastic urethane rubber or silicone rubber having a good wear resistance, and an electrode 53, preferably made of metal. When a transfer nip is formed with the photoconductive drum 1 in contact with the edge portion B of the rubber 52, the electrode 53 keeps a proper spacing with the photoconductive drum 1 (FIG. 1A).

A transfer bias may be supplied to the electrode 53 of the transfer device 5. The transfer bias is preferably +3 kV in this embodiment. When a copy sheet P is fed, the transfer device 5 moves in the direction of the arrow as shown in FIG. 1B. The electrode 53 of the transfer device 5 is designed to contact the back side of the copy sheet P. When the electrode 53 touches the back side of the copy sheet P, the copy sheet P may be charged to about +500 V, although its charge level may vary subject to the condition of the copy sheet P and ambient conditions, such as humidity.

As the sheet P contacts the photoconductive drum 1 and the electrode 53 touches the back side of sheet P, the toner image on the photoconductive drum 1 may be drawn to the copy sheet P. The transfer process is thus successfully performed.

The transfer device of the present invention was compared to a conventional roller-type transfer device in transfer performance. The comparison was made for different sheet sizes and under different ambient conditions.

TABLE 1

Transfer performance under normal conditions

| | Sheet size A4 (extending along the full length of the drum) | Sheet size A5 (extending along the half length of the drum) |
|---|---|---|
| Transfer roller (electrically conductive rubber) | Good | Poor |
| Transfer roller (medium resistance rubber) | Good | Good |
| First embodiment | Good | Good |

TABLE 2

Transfer perforMance under high temperature and high humidity conditions (32.5° C., 85%)

| | Sheet size A4 (extending along the full length of the drum) | Sheet size A5 (extending along the half length of the drum) |
|---|---|---|
| Transfer roller (electrically conductive rubber) | Good | Poor |
| Transfer roller (medium resistance rubber) | Good | Poor |
| First embodiment | Good | Good |

The above tables show that a transfer roller of electrically conductive rubber fails to work in many situations. In practice, medium resistance or high resistance rubber is used for the transfer roller. Operating environments vary from season to season, and from place to place across the world. Under high temperature and high humidity conditions, the resistance of rubber varies substantially, and sometimes by one to two orders of magnitude. Even with a consistently applied voltage, a transfer current supplied to the copy sheet may be reduced to one-tenth to one-hundredth of its original power, and hence, a transfer fault is inevitable (see Table 2).

In the conventional roller transfer device, a roller, also serving as an electrode, is often continuously in contact with a photoconductive drum or a copy sheet. When the size of the passing copy sheet P is shorter than the longitudinal length of the photoconductive drum (along the axis of rotation), for example, in case of an A5 sheet size, the transfer roller has a smaller resistance in its portion in direct contact with the photoconductive drum. Such a portion makes a bypass circuit, which fails to supply a transfer current to the copy sheet, and leads to a transfer fault. In the development of the transfer roller, electrical resistance along the longitudinal length of the photoconductive drum, namely, electrical resistance of the transfer roller rubber portion has to be accurately and finely controlled. Determining the settings for accurate and fine control of electrical resistance is extremely difficult and increases the cost of the roller. In this embodiment, the photoconductive drum, along the portion of its longitudinal length having no copy paper to contact, has a sufficiently high resistance compared to the portion of its length in contact with the copy sheet. The transfer current is thus reliably supplied to the copy sheet and not to the photoconductive drum 1 (Table 2).

Second embodiment

Figure 3:
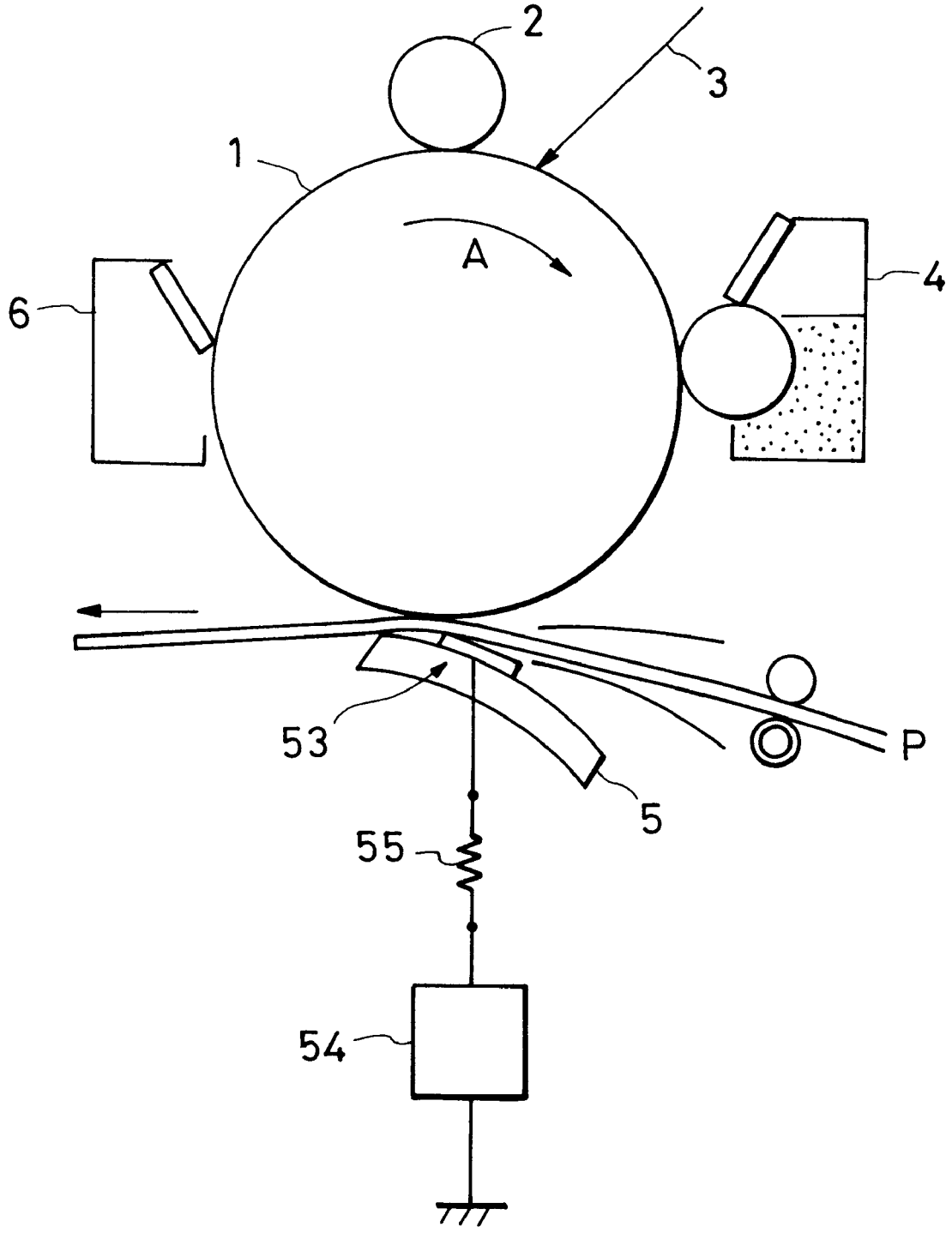
FIG. 3 is a cross-sectional view showing a critical portion of an image forming apparatus of another embodiment of the present invention.

The present invention presents provides a substantially consistent performance of the transfer device regardless of the size of the copy sheet and variations in ambient operating conditions. In the transfer device of the first embodiment, the transfer performance may suffer instability attributed to impedance variations arising from the conditions of the copy sheets and the thickness of the photoconductive body. To reduce instability, a second embodiment employs a protective resistor 55 in series between the electrode 53 and a DC power supply 54 as shown in FIG. 3. Table 3 shows the result from the use of resistor 55.

TABLE 3

Effect of protective resistor in transfer performance

| | Normal conditions | Low humidity condition (15° C., 10%) |
|---|---|---|
| First embodiment | Good | Poor |
| Second embodiment protective resistance 1 kΩ | Good | Acceptable |
| Second embodiment protective resistance 1 MΩ | Good | Good |
| Second embodiment protective resistance 10 MΩ | Good | Good |
| Second embodiment protective resistance 100 MΩ | Good | Acceptable |
| Second embodiment protective resistance 1 GΩ | Acceptable | Poor |

Table 3 shows the effect of embodiments having a range of protective resistances as compared to an embodiment having no protective resistance (the first embodiment). The above results are representative only and may fluctuate based on the variation in the resistance and the process speed. By selecting an optimum resistance, a reliable result may be obtained. The protective resistance preferably falls within a range from 1 kΩ to 100 MΩ.

Third embodiment

Figure 4:
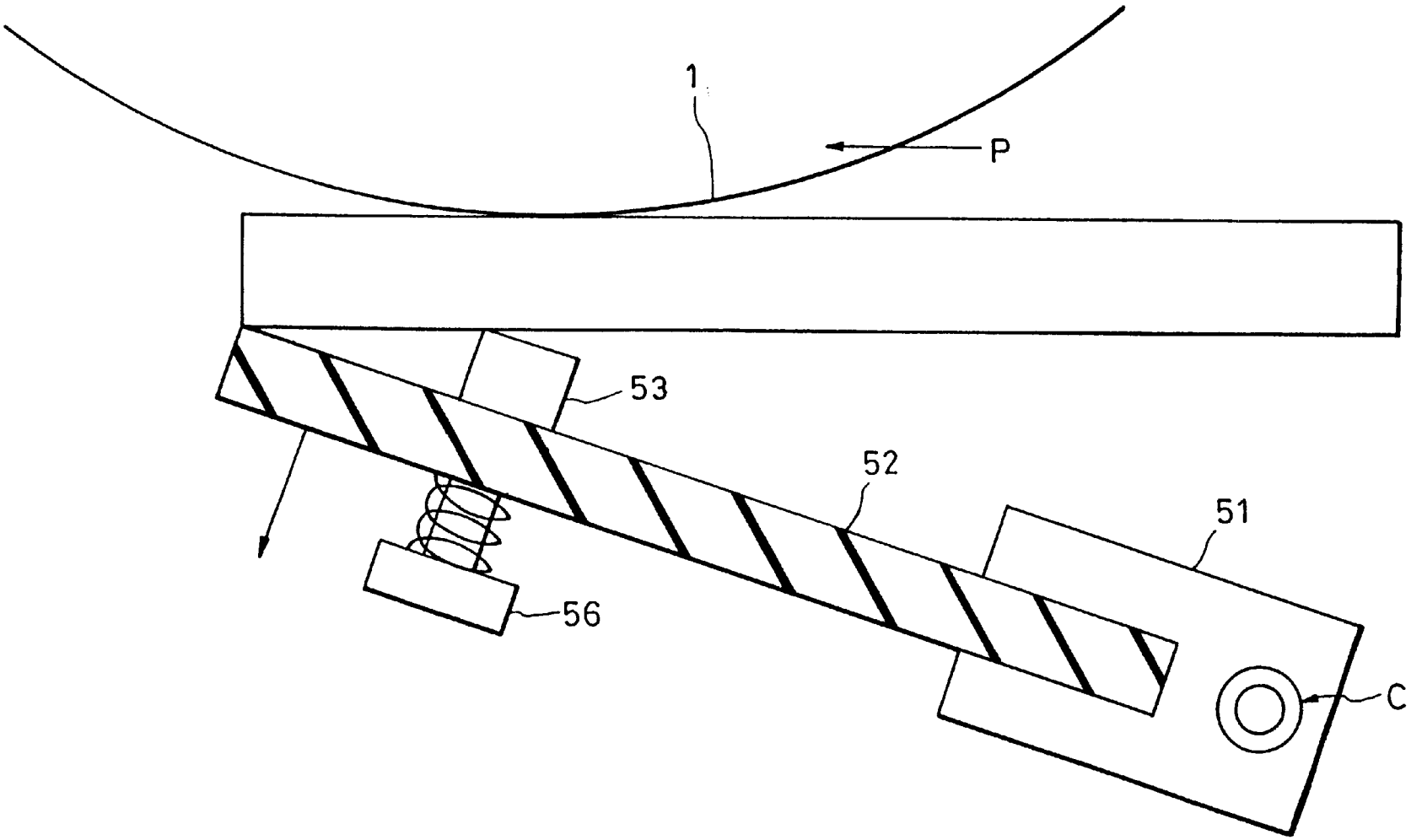
FIG. 4 is an enlarged cross-sectional view of the transfer device shown in FIG. 3.

Further to the technique in the second embodiment, the transfer bias may be changed based on the thickness of the copy sheet. If the transfer current is fed at the same time as the copy sheet enters a transfer zone, the transfer operation becomes more reliable. In the third embodiment, when the copy sheet P enters the transfer device as shown in FIG. 4, the transfer blade 52 may be pressed down about a hinge C in the direction of the arrow. A pressure sensor 56 may measure the timing and travel of pivot (displacement), and a transfer bias dependent on the displacement is applied to the electrode 53 at the measured timing. A reliable transfer operation is thus carried out.

Since a soft and elastic member, which may also be used for a cleaning blade, is in contact with the image bearing body as described above, the image bearing body is free from scratches and grinding. Preferably, the electrode does not contact the image bearing body at any point on the surface of the elastic member, but is positioned to feed a transfer charge to the back side of the copy sheet. Accordingly, the electrode is not smeared by the dirt on the image bearing body. Even if the electrode is smeared, the electrode is cleaned immediately because it remains under friction with each passing copy sheet. The electrode is thus used for a long period of time without any problem. Furthermore, an electrode operating from a DC supply is less costly. Since the elastic member is in contact with the image bearing body, the spacing between the electrode on the elastic member and the image bearing body may be accurately assured. Thus, the image forming apparatus provides a reliable transfer performance.

Although the present invention has been described by referring to the preferred embodiments thereof, many variations will be possible within the scope and spirit of the present invention.

What is claimed is:

1. A transfer device comprising:

an image bearing body bearing a toner image for transfer to a copy medium;

an electrode providing a charge to the copy medium; and a support member in pressure contact with said image bearing body, wherein said electrode is positioned on said support member, is out of contact with said image bearing body, and comes into contact with the copy medium when the copy medium is fed through said transfer device.

2. A transfer device according to claim 1, wherein the toner is charged and said electrode provides a transfer bias to the copy medium with a voltage having a polarity opposite to that of a voltage of the charged toner.

3. A transfer device according to claim 1, wherein said support member has a rubber elasticity.

4. A transfer device according to claim 3, wherein said support member has the shape of a blade.

5. A transfer device according to claim 1, where said electrode is positioned on said support member upstream of a pressure contact point of said support member in the direction of feeding of the copy medium.

6. A transfer device according to claim 2, further comprising a resistor in series between said electrode and a power source for charging said electrode.

7. A transfer device according to claim 6, wherein said resistor provides a resistance in the range of about 1 KΩ to 100 MΩ.

8. A transfer device according to claim 6, further comprising a sensor sensing a displacement of said support member caused by the feeding of the copy medium, wherein the magnitude of the voltage of the transfer bias from said electrode is varied ion accordance with a sensing result from said sensor.

9. A transfer device according to claim 6, further comprising a sensor sensing a displacement of said electrode caused by the feeding of the copy medium, wherein the magnitude of the voltage of the transfer bias from said electrode is varied in accordance with a sensing result from said sensor.

* * * * *

UNITED STATES PATENT AND TRADEMARK OFFICE

CERTIFICATE OF CORRECTION

PATENT NO. : 6,029,037
DATED : February 22, 2000
INVENTOR(S) : Nobuyuki Ito

It is certified that error appears in the above-identified patent and that said Letters Patent is hereby corrected as shown below:

Column 3,
Line 1, "Charging" should read -- Charging -- (begin new paragraph).
Line 4, "The" should read -- The -- (begin new paragraph).
Line 11, "The" should read -- The -- (begin new paragraph).
Line 18, "Preferably," should read -- Preferably, -- (begin new paragraph).
Line 22, "The" should read -- The -- (begin new paragraph).
Line 34, "A transfer" should read -- A transfer -- (begin new paragraph).
Line 44, "As" should read -- As -- (begin new paragraph).
Line 48, "The" should read -- The -- (begin new paragraph).

Column 36,
Line 34, "ion" should read -- in --.

Signed and Sealed this

Fifth Day of March, 2002

*Attest:*

*Attesting Officer*

JAMES E. ROGAN
*Director of the United States Patent and Trademark Office*